US006352098B1

(12) United States Patent
Kinjo

(10) Patent No.: US 6,352,098 B1
(45) Date of Patent: Mar. 5, 2002

(54) METHOD OF RECOVERING AND REFINING FILLER FROM A LOST WAX COMPOSITION

(75) Inventor: Tsuneo Kinjo, Chiba (JP)

(73) Assignee: Kawasaki Steel Techno-Research Corporation, Tokyo (JP)

( * ) Notice: Subject to any disclaimer, the term of this patent is extended or adjusted under 35 U.S.C. 154(b) by 0 days.

(21) Appl. No.: 09/660,454

(22) Filed: Sep. 12, 2000

(30) Foreign Application Priority Data

Sep. 14, 1999 (JP) ..... 11-260834

(51) Int. Cl.[7] ..... B22C 9/00
(52) U.S. Cl. ..... 164/5; 208/24; 164/35
(58) Field of Search ..... 164/5, 35; 208/24

(56) References Cited

U.S. PATENT DOCUMENTS 5,006,583 A 4/1991 Argueso ..... 524/277
6,066,250 A * 5/2000 Kinjo ..... 208/24

FOREIGN PATENT DOCUMENTS

EP 0914885 A1 5/1999
JP 58132091 8/1983
JP 1005639 1/1989

* cited by examiner

*Primary Examiner*—Nam Nguyen
*Assistant Examiner*—Ing-Hour Lin
(74) *Attorney, Agent, or Firm*—Young & Thompson

(57) ABSTRACT

When a waste wax composition containing a filler is treated so that the filler is recovered and thus reclaimed, almost all the impurities coming from the lost wax casting mold may be removed, thereby recovering and thus refining at a high purity, a filler of a lost wax composition. Crude reclaimed filler is first produced by dissolving and dispersing a waste wax composition in an organic solvent, and separating a dissolved wax phase from a solids/wax-containing fraction. The crude reclaimed filler is then dispersed in an aqueous alkaline solution, so as to dissolve and thus remove alkali-soluble impurities, followed (or preceded) by dispersion in an acidic aqueous solution so as to dissolve and thus remove acid-soluble impurities.

9 Claims, 1 Drawing Sheet

FIGURE
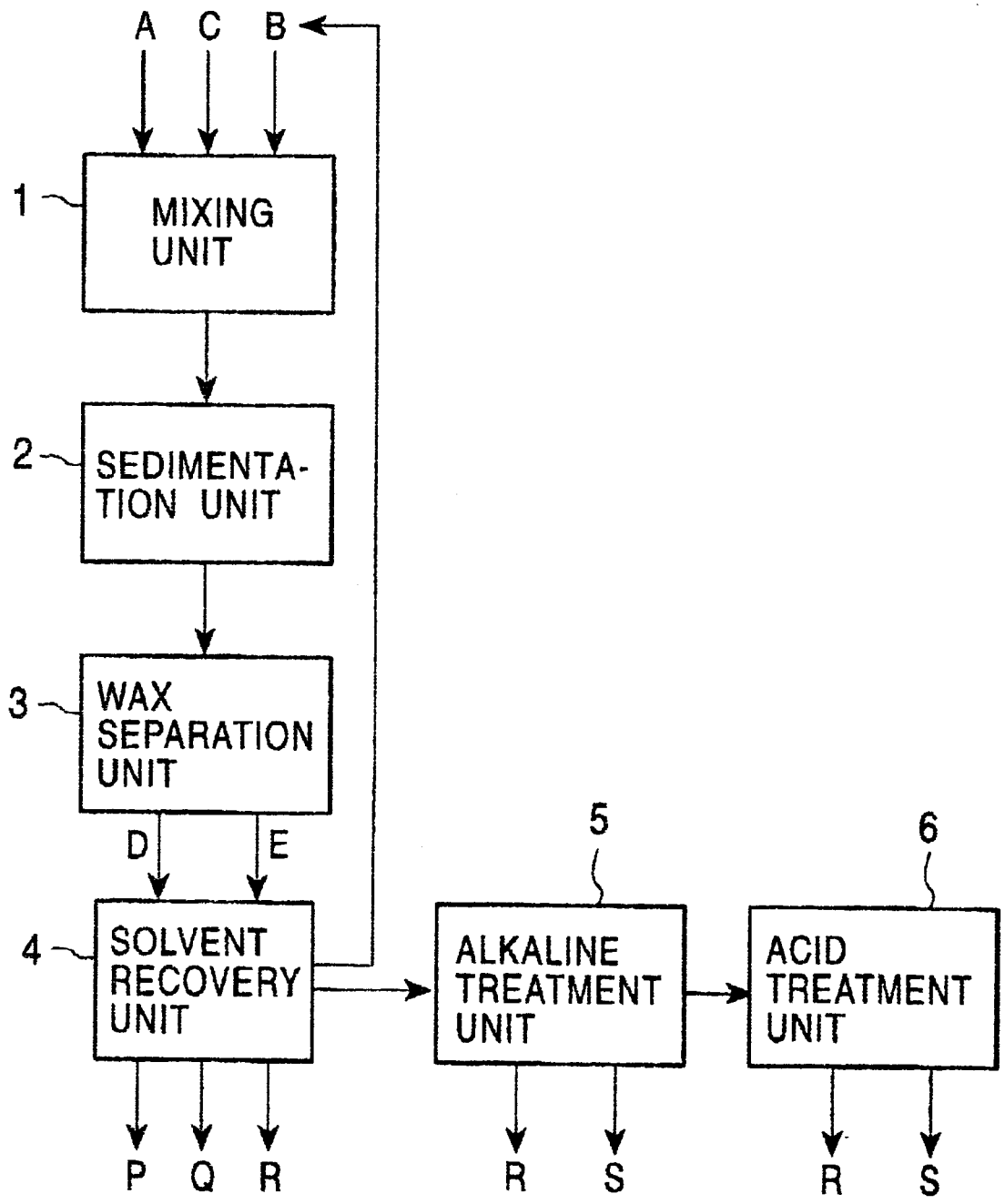

METHOD OF RECOVERING AND REFINING FILLER FROM A LOST WAX COMPOSITION

BACKGROUND OF THE INVENTION

1. Field of the Invention

The present invention relates to a method for reclaiming a lost wax composition which is used in a lost wax precision casting process. In particular, this invention relates to a method for recovering a filler containing only an extremely small amount of ash, from a filler-containing waste lost wax composition generated during a dewaxing process using an autoclave.

2. Description of Related Art

Lost wax precision casting is a known method of carrying out precision casting in industry. According to this method, at first, either a silicon rubber matrix or a die is used to prepare a pattern using wax, so as to obtain a wax pattern having the same shape as the final product. Then, the wax pattern is coated with a refractory ceramic material, followed by a dewaxing process in which the wax pattern is heated so as to elute the wax, thereby obtaining a casting mold. Molten metal is then poured into the casting mold so as to produce various precision products.

For dewaxing in such methods, there has long been widely used a steam dewaxing method since this method is effective for recovery and reclamation of the wax. According to this method, the casting mold coated with a ceramic material is introduced into an autoclave, and is heated in steam to a temperature of 150 to 180° C. In this manner, the wax may be melted so as to be discharged.

The wax discharged from the dewaxing process is thus recovered and is then subjected to a reclaiming treatment so as to obtain reclaimed wax which can again be used in preparing a wax pattern. To improve heat conductivity and to prevent shrinkage at thick portions of a wax pattern, it has been suggested to include in the lost wax composition an organic filler formed of a polystyrene and having an average diameter of 40 $\mu$m, with its content being twenty to thirty percent of the lost wax composition. However, as the organic filler is expensive, it has become more and more desired to recover and reclaim not only the wax component but also the filler component.

However, no viable techniques have been proposed to recover the wax component together with the filler component from the waste wax composition. On the other hand, an improved method has been suggested and put into practical use, as suggested by the inventors of the resent invention in Japanese Unexamined Patent Application Publication No. 11-192534 (U.S. Pat. No. 6,066,250). According to that method, an amount of waste wax composition containing the filler and/or an amount of residue formed by separating or extracting the wax component from the wax composition are required to be dissolved and dispersed in an organic solvent, so that a solution is thus formed. After that, the solution is separated into a phase (fraction) in which the wax has been dissolved (a dissolved wax fraction) and another phase (fraction) containing solid and wax components. Subsequently, the wax component and the organic solvent are removed from the phase containing solid and wax components, thereby obtaining desired reclaimed filler. The reclaimed filler is then treated in an aqueous alkaline solution, thus obtaining an amount of refined filler having a high purity.

With the use of the above method, it has become possible to recover the filler from the waste lost wax composition, so that it is possible to reuse the recovered filler. However, the waste wax composition usually contains some solid components such as sand and iron, and also contains various other additives used in a lost wax casting process, such as a colloidal silica for use as an adhesive agent and CaO for use as a disintegrator. For this reason, there has been a demand that the above solid components and various other additives be removed as completely as possible in order to ensure a high purity for the filler.

In fact, the method taught by U.S. Pat. No. 6,066,250 has proven to be relatively capable of meeting the above requirements. However, as will be appreciated from the results of further research conducted by the inventors of the present invention and described below, the recovered filler still contains some solid components which fail to be completely removed therefrom. As a result, it has become clear that if the recovered and refined filler is used by itself, it would be difficult to solve the above problems sufficiently.

SUMMARY OF THE INVENTION

Accordingly, it is an object of the present invention to provide a method of treating the waste wax composition and/or remaining materials (wax recovery residue) formed by separating or extracting the wax component from the filler-containing waste wax composition, so as to recover and reclaim the filler, while almost completely removing the impurities coming from the lost wax casting mold, thereby recovering a filler of a lost wax composition at an extremely high purity.

Specifically, the inventors of the present invention have found that iron and calcium are contained in an impurity component of recovered filler, and it is possible to dissolve and thus remove the impurity by dispersing the recovered filler into an acidic aqueous solution. The present inventors have further discovered that if a surface active agent such as a detergent is added at a time when a crude reclaimed filler is dispersed into an aqueous alkaline solution, the dispersion of the wax component into the aqueous alkaline solution is promoted, so that the refining of the filler component can be made much easier. Moreover, the present inventors have also found that an appropriate adjustment of the concentration of the aqueous alkaline solution will allow an easier separation for separating the solid impurities from the filler component.

The present invention is therefore a method of recovering and refining a filler of a lost wax composition, comprising: separating a crude reclaimed filler, in which one or both of i) a waste wax composition containing a filler, and ii) a residue formed by separating or extracting a wax component from the waste wax composition, are dissolved and/or dispersed in an organic solvent, the whole system is then separated into a dissolved wax phase and a solids/wax-containing fraction, thereby removing and thus recovering the wax component and the organic solvent component from the solids/wax-containing fraction; said method further comprising: a) an alkali-washing process wherein the crude reclaimed filler is dispersed in an aqueous alkaline solution, so as to dissolve and thus remove some impurities soluble in an alkaline solution; b) an acid-washing process wherein the crude reclaimed filler is dispersed in an acidic aqueous solution so as to dissolve and thus remove some impurities soluble in an acid. Further, it is preferred that subsequent to the alkali-washing process and the acid-washing process, a water-washing process is carried out for washing the filler component with water.

At this time, it is preferred that during the alkali-washing process, a surface active agent is added in to the aqueous alkaline solution, thereby enhancing the dispersion of the crude reclaimed filler in the alkaline solution.

Further, during the alkali-washing process, the specific gravity of the alkaline solution is adjusted to be larger than that of the wax component, but smaller than the specific gravity of the filler component. In this way, the separation and the removal of the wax component attached to the crude reclaimed filler will become much easier, thereby making it possible to more efficiently separate and remove the solid impurities.

Further, according to the present invention, there is provided another method of recovering and refining a filler of a lost wax composition, said method comprising: separating a crude reclaimed filler, in which one or both of i) a waste wax composition containing a filler, and ii) a residue formed by separating or extracting a wax component from the waste wax composition, are dissolved and thus dispersed in an organic solvent, the whole system being then separated into a dissolved wax phase and a solids/wax-containing fraction, thereby removing and thus recovering the wax component and the organic solvent component from the solids/wax-containing fraction; alkali-washing wherein the crude reclaimed filler obtained in the above process is dispersed in an aqueous alkaline solution, a surface active agent being added to the alkaline solution, so as to dissolve and thus remove some impurities soluble in an alkaline solution; a water-washing process wherein the filler treated in the alkali-washing process is washed with water so as to obtain a refined filler. Therefore, it is possible to more completely separate and remove the solid impurities in the alkali-washing process.

In addition, according to the present invention, the solids/wax-containing fraction may be a phase containing an aqueous phase. In this way, the water removal treatment, which is otherwise needed for treating and thus removing the water contained in the waste wax composition, can be dispensed with.

BRIEF DESCRIPTION OF THE DRAWING

The sole FIGURE is a system diagram indicating an apparatus for carrying out the present invention.

DESCRIPTION OF PREFERRED EMBODIMENTS

An embodiment of the present invention will now be described with reference to the accompany drawings.

The method of the present invention is suitable for treating a filler-containing waste wax composition, for example, a waste wax composition discharged from an autoclave. No further heat load need be exerted on either the wax or filler, since the method does not require a melting step which is needed in the prior art for separating and removing the wax component from the waste wax composition. As a result, the invention has an advantage that the wax and the filler are less likely to be deteriorated or decomposed.

Furthermore, the method of the present invention is also suitable for treating a residue formed by separating or extracting the wax component from the waste wax composition. Namely, the method of the invention is suitable for treating a residue formed by using a conventional process to melt the waste wax composition containing an amount of filler generated from an autoclave, followed by recovering the wax through a static separation (sedimentation), a centrifugal separation, a filtering treatment and other suitable treatments. Application of the present method in conjunction with such conventional processes permits using only a small amount of solvent. Moreover, the conventional hazard that the wax and the filler will deteriorate due to a heat associated with the melting treatment of the waste wax composition, can be greatly abated by application of the present method, which permits the time period for separating the wax component after the melting treatment to be controlled to be as short as possible. For example, it is preferred to use the centrifugal separation, and the filtering treatment. Moreover, even with regard to the static separation, if the wax component is recovered and remainder is treated as a residue under a condition where the filler and other impurities are not completely precipitated, a time period necessary for wax component separation and its removal is allowed to be reduced.

The waste wax composition and the above residue are mixed with a solvent so that the wax may be dissolved in the solvent, while solid substances such as the filler is dispersed in the solvent containing the wax. Here, for use as a solvent, there should not be any limitation, provided that a solvent is capable of dissolving the wax component contained in the waste wax. In detail, several kinds of solvents which can be used in the present invention, including organic solvents such as chloroform, benzene, toluene, xylene, n-hexane, cyclohexane, n-heptane, acetone, methanol, ethanol, kerosene, which may be used alone or in the form of a mixture. It is particularly preferred to use n-hexane, since it has a boiling point lower than 100° C., excellent dissolving power for wax, does not deteriorate polystyrene which is often used as a filler, and is immiscible with water, which eases the separation of the water component from the waste wax composition.

The above waste wax composition or the wax recovery residue is used as a raw material to which is added the above organic solvent so as to obtain a raw material mixture. If desired, heat can be added to accelerate the dissolution of the was component, and the whole raw material mixture is stirred so that the wax component is dissolved into the organic solvent, and the filler and the impurities are thus dispersed in the solvent containing the wax. Subsequently, by static separation (sedimentation), a phase in which only wax has been dissolved (dissolved wax phase) is separated from a solids/wax-containing fraction (filler-containing phase). Then, a conventional technique is used to evaporate the solvent from the dissolved wax phase, thus recovering the wax component which can be used as a reclaimed wax.

With regard to the filler-containing phase, the lower portion thereof is removed which contains a large amount of solid impurities precipitated downwardly during the static separation, and only the upper portion thereof is taken out. Then, the solvent is evaporated so as to recover the filler. In this way, an amount of crude reclaimed filler may be obtained. However, the obtained crude reclaimed filler still contains a wax component. Then, an organic solvent is added so that a separation treatment may be repeated to separate the whole system into a dissolved wax phase and a solids/wax-containing fraction (containing solid component and wax component), thereby removing the wax component.

However, the crude reclaimed filler obtained in the above process still contains some heavy solid components such as sand and iron, also contains a binder (such as colloidal silica) or its modified substance previously added for molding the lost wax casting pattern, with an ash content being about 0.4 wt %. Accordingly, it is preferred to remove the heavy solid components and binder component. In detail, the crude reclaimed filler obtained in the above process is dispersed into an aqueous alkaline solution, to elute the alkali-soluble substance so as to remove alkali-soluble impurities. Meanwhile, the lower portion thereof is removed which contains a large amount of solid impurities precipitated downwardly during the static separation, only the upper portion thereof is taken out, thereby completing the alkali-washing treatment in which the heavy solid components are removed.

According to the present invention, it is preferred to add a surface active agent in the above alkali-washing treatment. In this way, the wax component mixed with the filler component may be easily separated from the filler particles, so that the filler particles may be sufficiently dispersed without being aggregated, thereby enhancing the dispersion of the wax in the aqueous alkaline solution. For this reason, the impurities including the heavy solid components enclosed within the wax component may be easily separated from the wax component by precipitation, and thus be removed therefrom together with the wax component. Thus, the purity of the filler can be increased. Here, a surface active agent used in the above process may be any one selected from a large group of substances which are generally for use in washing treatment. For example, it is allowed to use a detergent commercially available under a trade name RBS 35 which is manufactured by Junsei Kagaku Co., Ltd.

Here, although there is not any limitation to the kinds of alkalis which may be used in the above alkali-washing process, it is preferred to use a caustic soda (NaOH). In fact, when an aqueous solution of a caustic soda is used, the wax component will be partially alkalified so that it will be easily separated from the filler and the filler itself may be more easily dispersed in the aqueous solution. As a result, some impurities such as heavy solid components can be more smoothly separated therefrom.

Further, the concentration of the aqueous alkaline solution used in the above process is controlled within a range capable of dissolving the alkali-soluble substance contained within the crude reclaimed filler, with an 0.5 wt % aqueous solution being the most typical in the present invention. If such an aqueous solution is adjusted in a manner such that its concentration is increased and that its specific gravity becomes larger than that of the wax component but smaller than that of the filler component, dispersed and not-dissolved wax will float to the upper surface, while the filler component and solid impurities are caused to precipitated downwardly, thereby making it much easier to separate the filler. Moreover, the alkalifying of the wax may be made more smooth, so that it is possible to increase the purity of the filler component. The alkali concentration of the aqueous alkaline solution having the above effect, may be selected in accordance with the specific gravity of the filler component. The concentration of an aqueous NaOH solution is preferred to be within a range 0.5 to 10 wt %.

In a process of alkali-washing, if the washing treatment is carried out with the use of such a high concentration of alkali, the wax component will float upwardly during a process of static separation while the heavy solid components are concentrated and caused to precipitate, thereby enabling them to be easily separated from each other. Here, the removal of the solid components can be achieved in any of the processes, including the above described treatment using an organic solvent (crude reclaimed filler separation process). Nevertheless, since in the alkali-washing process the filler particles are extremely easy to be dispersed into the solution and thus make the solid components more easily separated by precipitation, the alkali-washing process is most preferred. For this reason, in the crude reclaimed filler separation process, it is not necessary to remove the lower portion containing the solid impurities. Instead, solid impurities can be removed at one time in an alkali treatment process from all the fillers and solid impurities after evaporating the solvent.

Subsequent to the above alkali-washing process, a water-washing process is performed so as to completely remove the alkali components. In this way, it is possible to obtain an amount of refined filler containing 0.05 to 0.07 wt % of residue (ash content) after being baked at a temperature of 950° C.

Using the above alkali-washing process, it is possible to remove almost all the components soluble in alkali (alkali-soluble components) and other heavy solid components. However, other impurities insoluble in alkali (alkali-insoluble impurities), such as CaO and iron, are difficult to remove completely. As a result, these impurities remain as ash components after baking treatment. In view of this, according to the present invention, an acid-washing process is added in order to remove these impurities. Here, although the acid-washing process may be conducted before the alkali treatment, it is preferred that such an acid-washing process be conducted after the alkali-washing treatment.

Namely, if an amount of filler treated in the alkali-washing process is dispersed in an acidic aqueous solution, it is possible to dissolve and thus remove some otherwise insoluble impurities (acid-soluble impurities), such as CaO and Fe added as a casting mold disintegrator. There is not any limitation to an acid for use in the present invention. For example, such an acid may be an organic acid such as citric acid and oxalic acid, or an inorganic acid such as hydrochloric acid, sulfuric acid, phosphoric acid and nitric acid. However, in order to make easier the water-washing treatment and a waste liquor treatment, it is preferred to use an organic acid or hydrochloric acid. The concentration of an acid is preferred to be controlled at about pH 2 or lower, provided that it can achieve the above described purpose.

Subsequent to the acid-washing process, a water-washing process is conducted again so as to completely remove the acid component. If a drying process is performed after the water-washing process, an amount of filler can be obtained which does not substantially contain impurities but has a high purity. Here, as water for use in the water-washing process, it is preferred to use pure water.

The sole FIGURE is a system diagram indicating an apparatus capable of carrying out the present invention using a static method. As shown in the diagram, the system involved in the apparatus includes a mixing unit 1, a sedimentation unit 2, a wax separation unit 3, a solvent recovery unit 4, an alkaline treatment unit 5 and an acid treatment unit 6.

The mixing unit 1 is provided with a stirring device (not shown). An amount of raw material A to be treated in the apparatus is a waste wax or a residue formed by separating and extracting a wax component from the waste wax. The raw material A is introduced into the mixing unit together with recovered solvent B and supplementary solvent C, so that the raw material and solvents are mixed together by virtue of a stirring action. In this way, the wax component is dissolved in the solvent while the filler and the solid impurities are dispersed in the same solvent.

The sedimentation unit 2 is a container for receiving and sedimenting an amount of a solution containing dispersed solids treated in the mixing unit 1. In detail, the unit 2 is in the form of a tank which has an inlet and an outlet. The inlet is provided for receiving the above mixed raw material dispersion, while the outlet is provided for sending out a dissolved wax phase separated by an action of sedimentation. Although a syphon or a pump can be used to remove the dissolved wax phase, it is important that when an upper liquid portion is being removed, the contents of the upper liquid portion should not mix into the lower liquid portion.

Although the FIGURE indicates that the sedimentation unit 2 is provided independently from the mixing unit 1, such a sedimentation unit can be omitted. In fact, the mixing unit 1 itself can also serve as the sedimentation unit 2. In other words, after the wax dissolving has been completed by virtue of the mixing and the stirring in the mixing unit 1, the mixing unit 1 can also function as a sedimentation unit 2 if the mixing and the stirring are stopped and the unit itself is kept still.

The wax separation unit 3 separates a dissolved wax phase D and a filler-containing phase E. In practice, the wax separation unit 3 is usually a centrifugal separation device or a filtering device. If a centrifugal separation device or a filtering device is used, the separation of the dissolved wax phase and the separation of the filler-containing phase may be completed more quickly, thereby making it possible to prevent the wax and filler from becoming deteriorated due to heat. Although it has been described in the present embodiment that the mixing unit 1 and sedimentation unit 2 and the wax separation unit 3 are arranged independently from one another, it is in fact also possible to have the functions of these three units included in only one unit. However, if the separation is carried out only in the sedimentation unit, the wax separation unit 3 may be omitted.

Moreover, it is also possible to add a solvent and disperse therein the residue obtained in the centrifugal separation process, followed by another centrifugal separation.

The solvent recovery unit 4 is provided for receiving respectively the various phases separated in the above sedimentation unit 2 and the wax separation unit 3, so as to evaporate the solvent, thereby obtaining a wax fraction P, crude reclaimed filler Q and heavy solid impurities R. In particular, the solvent recovery unit 4 preferably includes a heating device for evaporating the solvent, a discharge device for discharging some solid components such as wax, and a condensation device for cooling and condensing the evaporated solvent. The solvent recovered in this unit is used as recovered solvent B which is fed again into the mixing unit 1.

However, the solid impurities fraction R need not be separated in the solvent recovery process. Indeed, there may be no economic incentive even to recover the solvent at all, such that this is strictly an optional aspect of the present invention.

The alkali treatment unit 5 is provided to conduct an alkali treatment on crude reclaimed filler obtained from the solvent recovery unit 4, so as to separate some heavy solid impurities R. In detail, the alkali treatment unit is in the form of a tank which is capable of receiving residue not containing the wax, blending the residue into an aqueous alkaline solution, effecting a sedimentation treatment, and is also capable of discharging some floating substances, upper clear liquid and heavy solid impurities and filler. Further, the alkali treatment unit 5 is provided with a water-washing device for removing alkali component from these discharged substances.

The acid treatment unit 6 is provided to acid-treat the crude reclaimed filler obtained from the alkali treatment unit 5 so as to remove the impurities soluble in an acid. In detail, the acid treatment unit is in the form of a tank which is capable of receiving a reclaimed filler, blending the filler into an acidic aqueous solution, thus effecting a sedimentation treatment, and also is capable of discharging upper clear liquid and the filler. Further, the acid treatment unit is provided with a water-washing apparatus for removing acidic components from these discharged substances.

The following examples will further illustrate and enable the present invention, but, as with the foregoing description of embodiments, should not be used to improperly limit the scope of the appended claims.

EXAMPLE 1

300 ml of n-hexane was added as a solvent to 200 g of waste wax composition, followed by heating and stirring until the waste wax composition was dissolved and dispersed in the solvent. After sedimentation, the whole system was separated into two phases, with one phase being a dissolved wax phase containing a wax component, and the other phase being a filler-containing phase containing filler and solid impurities. Then, the dissolved wax phase was removed and solvent was evaporated to recover the wax component.

Subsequently, n-hexane is again added as a solvent into the remaining filler-containing phase, followed by heating and stirring treatments so that the filler-containing phase was again dispersed in the solvent. After standing still, the whole system was separated into two phases, with one phase being a dissolved wax phase containing a wax component which was previously existing in the filler-containing phase but had been dissolved, and the other phase being a filler-containing phase containing filler and solid impurities. Then, the dissolved wax phase was removed. Subsequently, the same operation (adding a solvent into the remaining filler-containing phase and then taking out the dissolved wax phase) as the above was repeated five times. As a result, it was found that the dissolved wax phase had almost become transparent, i.e., no wax component was found to be existing in solvent.

After that, the solvent was evaporated from the obtained filler-containing phase, thereby producing crude reclaimed filler. Then, the crude reclaimed filler was put into an alkaline solution formed by dissolving 3.0 g of NaOH and 10 g of a surface active agent (a detergent commercially available under a trade name RBS 35, manufactured by Junsei Kagaku Co., Ltd) into 500 ml of water. Then, the whole system was heated to a temperature of 80° C. and stirred for one hour, to cause the crude reclaimed filler to disperse in the alkaline solution, thereby eluting some impurities (soluble in alkali) into the alkaline aqueous solution. After sedimentation, the whole system was separated into an upper clear phase having a dark brown color and a lower filler-precipitated phase containing solid impurities. Subsequently, the upper clear phase was taken out and removed therefrom. Afterwards, the lowermost portion was taken out which contains concentrated and precipitated solid impurities corresponding to about ten percent of the remaining filler-precipitated phase. Then, the filler-precipitated phase from which the solid components have been removed was moved to the centrifugal filter, and pure water was sprinkled thereon so as to facilitate a desired centrifugal filtering treatment. By washing using pure water in this manner, the alkaline components remaining in the filler-precipitated phase were removed completely.

The filler component from which alkali has already been removed through the above water-washing process was put into citric acid solution formed by dissolving 10 ml of citric acid into 500 ml of a pure water. Then, the dispersion was heated to a temperature of about 65° C. and stirred for about one hour, while at the same time eluting some impurities (soluble in citric acid) in the citric acid solution. After that, the whole system was moved to a centrifugal filter, and an amount of pure water was sprinkled thereon so as to facilitate a desired centrifugal filtering treatment. In this way, the citric acid and the dissolved impurities were removed by the water-washing treatment. Finally, the water component was evaporated and refined filler was thus obtained.

The residue formed after baking the refined filler at a temperature of 950° C. was found to be only 0.04 wt %. Thus, it was demonstrated that with the use of the present invention, it is possible to recover 90 percent of the filler contained in the waste wax composition, with the recovered filler having a high purity. This means that using the above method not only makes it possible to elute and thus remove some impurities through the treatment using an alkaline solution, but also can remove some solid impurities (insoluble in an alkaline solution) by precipitation, thereby making it possible to dissolve and thus remove the remaining acid-soluble impurities (insoluble in an alkaline solution) with an acid such as citric acid.

EXAMPLE 2

The crude reclaimed filler obtained in the same way as in Example 1 was put into an alkaline solution formed by dissolving 15 g of NaOH and 10 g of a surface active agent (a detergent commercially available under a tradename RBS 35, manufactured by Junsei Kagaku Co., Ltd) into 500 ml of water. Then, the whole system was heated to a temperature of 90° C. while at the same time being stirred for 30 minutes, so as to cause the crude reclaimed filler to disperse in the alkaline solution, thereby eluting some impurities (soluble in alkali) into the alkaline aqueous solution. After sedimentation, the whole system was formed into an upper floating layer containing substances separated from the crude reclaimed filler, an upper clear phase having a dark brown color, and a lower filler-precipitated phase containing solid impurities. Subsequently, the upper floating substances and the upper clear phase were removed. Then, pure water was added and the dispersion was heated again to a temperature of 90° C., thereby re-dispersing the crude reclaimed filler. Afterwards, the whole system was allowed to sediment at room temperature, so as to form in the lower position a filler-precipitated phase containing impurities. In this way, an upper clear phase was taken out together with the lowermost portion containing concentrated and precipitated solid impurities corresponding to about ten percent of the remaining filler-precipitated phase. Then, the filler-precipitated phase from which the solid impurities have been removed was moved to the centrifugal filter, and pure water was sprinkled thereon so as to facilitate a desired centrifugal filtering treatment. By virtue of the washing process using the pure water in this manner, the alkaline components remaining in the filler-precipitated phase were thus removed completely.

The filler component from which alkali has already been removed through the above water-washing process was put into hydrochloric acid solution formed by dissolving 100 ml of hydrochloric acid in 400 ml of pure water. Then, the dispersion was heated to a temperature of about 65° C. and stirred for about 30 minutes, while at the same time eluting some impurities (soluble in hydrochloric acid) in the hydrochloric acid solution. After that, the whole system was moved to a centrifugal filter, and pure water was sprinkled thereon so as to facilitate a desired centrifugal filtering treatment. In this way, the hydrochloric acid and the dissolved impurities were removed by virtue of the water-washing treatment. Finally, the water component was evaporated and refined filler was thus obtained.

The residue formed after baking the refined filler at a temperature of 950° C. was found to be only 0.018 wt %. Thus, it was further demonstrated that with the use of the present invention, it is possible to recover 90 percent of the filler contained in the waste wax composition, with the recovered filler having a high purity. This means that using the above method makes it possible not only to elute and thus remove some impurities through the treatment using alkaline solution, but also to increase an efficiency for separating and refining the filler. Moreover, using the above method not only makes it possible to remove some solid impurities (insoluble in alkaline solution) by precipitation, but also can dissolve and thus remove at high efficiency the acid-soluble components (insoluble in alkaline solution) with an acid such as hydrochloric acid.

In this way, according to the present invention, when a crude reclaimed filler is refined which has been obtained by dissolving and dispersing a waste wax composition and the like in an organic solvent, the filler component may be effectively dispersed and further subjected to an acid-washing treatment, thereby dissolving and thus removing some impurities soluble in an acid. As a result, it is possible to produce a reclaimed filler having an extremely high purity. In this manner, each of the wax and the filler may be used again as a valuable substance. Furthermore, since the amount of waste material has been reduced greatly, some related environment problems have been alleviated to a great extent. Therefore, the above-described method of the present invention is beneficial not only in the field of precision casting industry, but also effective for the improvement of surrounding environment.

While the present invention has been described above in connection with several preferred embodiments, it is to be expressly understood that those embodiments are solely for illustrating the invention, and are not to be construed in a limiting sense. After reading this disclosure, those skilled in this art will readily envision insubstantial modifications and substitutions of equivalent materials and techniques, and all such modifications and substitutions are considered to fall within the true scope of the appended claims.

What is claimed is:

1. A method of recovering filler from a used lost wax composition, comprising:

separating crude reclaimed filler, in which at least one of a) a waste wax composition containing a filler, and b) a residue formed by separating or extracting a wax component from the waste wax composition, is dissolved and dispersed in an organic solvent, wherein a resulting dispersion is then separated into a dissolved wax phase and a solids/wax-containing fraction, and a wax component and an organic solvent component are recovered from said solids/wax-containing fraction, leaving said crude reclaimed filler;

dispersing the crude reclaimed filler in an aqueous alkaline solution, so as to dissolve and thus remove alkali-soluble impurities; and dispersing the crude reclaimed filler in an acidic aqueous solution so as to dissolve and thus remove acid-soluble impurities.

2. The method according to claim 1, wherein the specific gravity of the aqueous alkaline solution is adjusted to be greater than that of the wax component and smaller than that of said filler.

3. The method according to claim 1, wherein the solids/wax-containing fraction contains water.

4. The method according to claim 1, wherein subsequent to the dispersing in the aqueous alkaline solution and to the dispersing in acidic aqueous solution, water-washing is carried out for washing the filler component with water, respectively.

5. The method according to claim 2, wherein the specific gravity of the aqueous alkaline solution is adjusted to be greater than that of the wax component and smaller than that of said filler.

6. The method according to claim 4, wherein the solids/wax-containing fraction contains water.

7. The method according to claim 1, wherein a surface active agent is present in said aqueous alkaline solution.

8. The method according to claim 7, wherein the specific gravity of the aqueous alkaline solution is adjusted to be greater than that of the wax component and smaller than that of said filler.

9. The method according to claim 7, wherein the solids/wax-containing fraction contains water.

* * * * *